US006124832A

United States Patent [19]

Jeon et al.

[11] Patent Number: 6,124,832

[45] Date of Patent: Sep. 26, 2000

[54] STRUCTURE OF VEHICULAR ACTIVE ANTENNA SYSTEM OF MOBILE AND SATELLITE TRACKING METHOD WITH THE SYSTEM

[75] Inventors: Soon Ik Jeon; Soon Young Eom; Cheol Sig Pyo; Jae Ick Choi; Choon Sik Yim, all of Daejon, Rep. of Korea

[73] Assignee: Electronics and Telecommunications Research Institute, Daejeon, Rep. of Korea

[21] Appl. No.: 09/137,528

[22] Filed: Aug. 21, 1998

[30] Foreign Application Priority Data

Dec. 24, 1997 [KR] Rep. of Korea ..... 97-73711

[51] Int. Cl.[7] ..... H01Q 1/32

[52] U.S. Cl. ..... 343/711; 343/766; 342/375

[58] Field of Search ..... 343/711, 853, 343/755, 756, 872; 342/371, 372, 374, 375

[56] References Cited

U.S. PATENT DOCUMENTS 5,666,792 9/1997 Mullins ..... 56/10.2 A 5,826,165 10/1998 Echeita et al. ..... 455/2

5,831,545 11/1998 Murray et al. ..... 340/825.49

OTHER PUBLICATIONS

Jiro Hirokawa, Makoto Ando, Naohisa Goto, Nobuharu Takahashi, Takashi Ojima and Masahiro Uematsu; A Single–Layer Slotted Leaky Waveguide Array Antenna for Mobile Reception of Direct Broadcast from Satellite; 1995; pp. 749–754.

*Primary Examiner*—Tan Ho

*Attorney, Agent, or Firm*—Antonelli, Terry, Stout & Kraus, LLP

[57] ABSTRACT

This invention relates to a structure of an active antenna system of a mobile and a satellite navigation method using the system. The present invention provides a structure of an active antenna system of a mobile and a satellite tracking method using the system, in which beams are formed and then directed by using sub-array concept, the tracking accuracy becomes to high by using double beam satellite tracking mode for tracking the satellite, tracking loss is reduced and positions are more accurately tracked during movement using an absolute steering sensing mode.

9 Claims, 8 Drawing Sheets

STRUCTURE OF VEHICULAR ACTIVE ANTENNA SYSTEM OF MOBILE AND SATELLITE TRACKING METHOD WITH THE SYSTEM

BACKGROUND OF THE INVENTION

1. Field of the Invention

The present invention relates to a structure of a vehicular active antenna system and a satellite tracking method with the system, and more particularly, to a structure of a vehicular active antenna system and a satellite tracking method with the system having a satellite tracking function in order to receive signals for a satellite broadcasting or a satellite communication in a vehicles.

2. Discussion of the Related Art

In the prior art, in order to receive signals for satellite broadcasting and satellite communication in a vehicle, an antenna system having a fixed azimuth angle is used and the antenna system is controlled two-dimensionally and mechanically. However, in this case control of tracking speed and posture is complicated. On the contrary, in the present invention a phased array antenna system is used and the phases of unit antenna elements are controlled two-dimensionally.

FIG. 2 shows a structure of a phased array antenna according to a prior art.

Each of n unit antenna elements 21, 21-1, . . . , 21-n has an initial steering phase value, and a satellite signal receiver 22 determines magnitudes of received satellite signals and then transfers a received signal intensity information 23 to a satellite tracking processor 26. The information is provided to a tracking calculation processing program block 27 which performs satellite tracking, control selection, power control and power blocking control. The tracking calculation processing program block 27 discriminates the state and calculates accurate satellite steerings, and then transfers a beam steering control signal 28 to the unit antenna elements in order that the phases of the unit antenna elements are delayed such that the antenna elements are oriented toward a desired satellite steering. In this case, in order to determine a satellite tracking steering and a tracking velocity, a rotation angular rate information of a mobile from an angular rate sensor 24 are also processed and determined concurrently.

FIG. 3 shows a functional view for illustrating a method for forming a single beam in a conventional phased array antenna, and particularly, a method for forming a single beam of an antenna oriented at a desired antenna steering angle θ° at which a reception satellite signal 31 is incident.

If phase delay values are provided to each of unit phase shifters B1 to Bn using beam steering control signals 28 (see from FIG. 2), each of unit antenna elements A1 to An is delayed by phase differences ΔΦ among them in order that received satellite signals reach an equal phase simultaneously. In this case, the delay values relates to a distance difference d 32 between the antenna elements. The satellite signals reach the unit antennas to which the equal phase of signals are received and are coupled in a signal power combiner 33, becoming final antenna received satellite broadcasting signals 34 before reaching a receiver.

FIG. 4 shows a graph for illustrating a satellite tracking method in a prior phased array antenna, and particularly, a tracking method by which a satellite tracking processor (see 26 in FIG. 2) is used for satellite tracking. The antenna has a characteristic curve of magnitudes of antenna received satellite broadcasting signals according to the beam steering angles θ and Φ at a mobile position, and since the curve has a maximum value M, the satellite tracking processor (see 26 in FIG. 2) is programmed to detect magnitudes of the received satellite broadcasting signals (34 in FIG. 3) and always to trace the maximum value.

In such a phased array antenna, the number of phase-controlled elements are too many, and thus the control is complicated and the manufacturing cost becomes high. In addition, since either a mono-pulse satellite tracking mode or a step-tracking mode is applied to the satellite tracking, accuracy of the satellite tracking becomes low and loss of the tracking signal becomes high. Also, since a method for sensing a rotating velocity together with a steering using received signals and then calculating a relative steering is used for sensing the movement of the antennas, there are problems that when a vehicle with a mobile terminal passes through an area blocking the satellite signals for a long time, accuracy is lowered after recovering the satellite tracking and it needs a long time for passing through the blocking area.

SUMMARY OF THE INVENTION

Accordingly, the present invention is directed to a structure of an antenna system for tracking positions accurately while a mobile terminal moves and a satellite tracking method with the system, wherein in order that a mobile terminal such as a moving vehicle receives signals for a satellite broadcasting or a satellite communication, the antenna system applies antenna sub-array concept, controls an elevation angle in one-dimensional phased array and an azimuth angle one-dimensionally and mechanically, uses a double beam satellite tracking mode, thus enhancing the tracking accuracy and reducing the tracking loss, and uses an electronic compass sensing mode.

In order to achieve the above object, the structure of an active antenna system of a mobile of the present invention comprises an active channel sub-module divided into 4 groups which receive satellite signals transferred to an antenna radome; a signal power combiner which receives signals from the active channel sub-module and then couples them; a beam forming block which distributes the satellite signals from the signal power combiner and then forming a secondary beam on one hand, and couples the signal power on the other hand, transmitting satellite reception signals, angle control signals and a supply power in a relative rotation state of a fixed part and a rotating part to a rotary jointer which is not opened and continuously transmits and supplies them; a frequency converter which converts satellite information signals from the rotary jointer into intermediate frequencies; a satellite broadcasting receiver which provides signals which are frequency converted satellite information signals filtered by a band pass filter; a tracking signal converter which receives the satellite signals transmitted through the secondary beam formed in the beam forming block and detects the magnitudes of the satellite tracking information signals; a beam steering controller which transmits the satellite tracking information signals transferred from the satellite signal converter through the rotary jointer, performs calculations for forming beams for one-dimensional elevation angle control, and then calculates phase delay value codes of desired double beams assigned to a phase shifter; an electronic compass sensor which calculates satellite tracking information signals transmitted through the rotary jointer from the beam steering control together with the information processing results of the sensed movement of the mobile, creates azimuth angles, elevation angle information and tracking speed information, and provides three-axis posture informations of an absolute steering, a forward declination and a side declination; a driving controller which provides the azimuth angles and speed information created in the electronic compass sensor and controls and monitors a driving motor so as to control one-dimensional azimuth angle; a power supply module which supplies power from the vehicle power supply to each part of the system; and a rotation platform which receives the power from the power supply module through the rotary jointer and controls one-dimensionally the azimuth angle of the active antenna by the driving motor.

Also, in order to achieve the above object, a satellite tracking method of the present invention comprises steps of performing an open loop tracking using an electronic compass sensor in an initial satellite tracking after initialization of the system and then tracking an initial position of the satellite; confirming whether signals are detected as a result of the initial satellite position tracking; performing repeatedly an automatic antenna measurement tracking which applies a double beam satellite tracking as a closed loop tracking if any signal is not detected after confirming detection of a primary signal and the position of the satellite is captured; stopping an operation in an emergency based on a determination of a user if any signal is not detected after confirming detection of the primary signal, i.e., if an initial satellite tracking during a certain period has failed; confirming whether the signals are detected; performing repeatedly a satellite tracking as an open loop tracking which applies an electronic compass sensor if any signal is not detected after confirming the signal detection and thus the satellite tracking is failed; preceeding to the automatic antenna measurement tracking step if the signals are detected after confirming the signal detection and thus the satellite tracking has succeeded; confirming whether the signals are detected; preceeding to an automatic antenna measurement tracking step if any signals is not detected after confirming the signal detection; proceeding to the initial satellite tracking step if any signals is not detected after confirming the signal detection and thus the satellite tracking has failed.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the inventing and together with the description serve to explain the principle of the invention.

In the drawings.

Similar reference characters refer to similar pats in the several views of the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
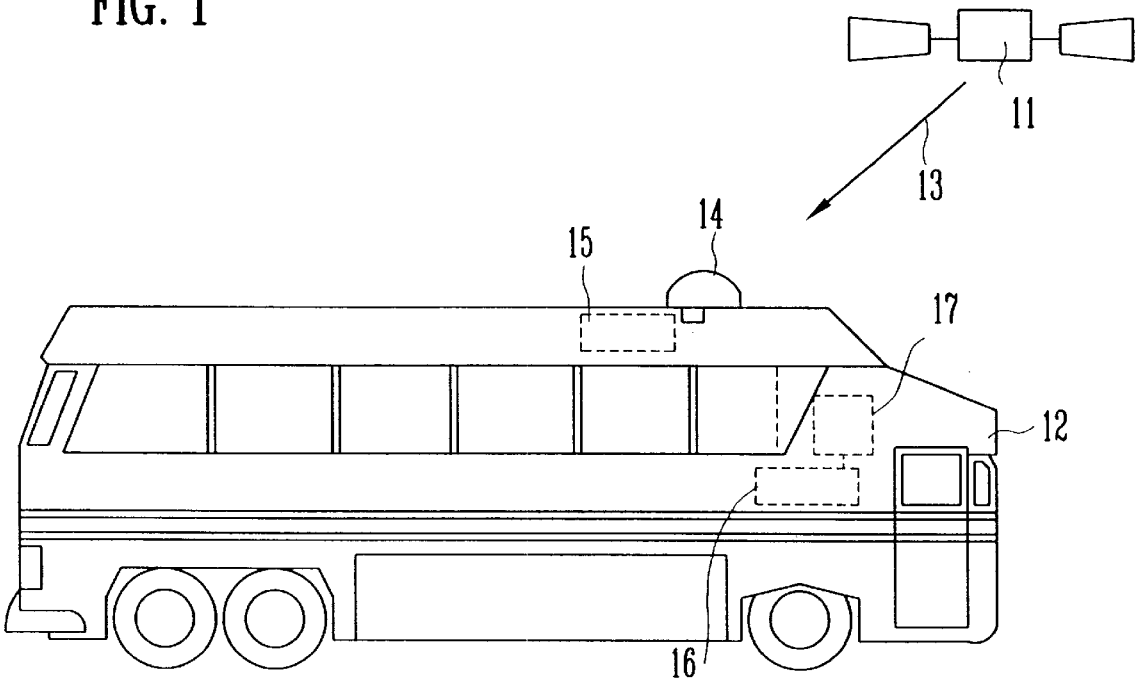
FIG. 1 shows a functional view for illustrating a structure for mounting an antenna on a vehicle.
Figure 2:
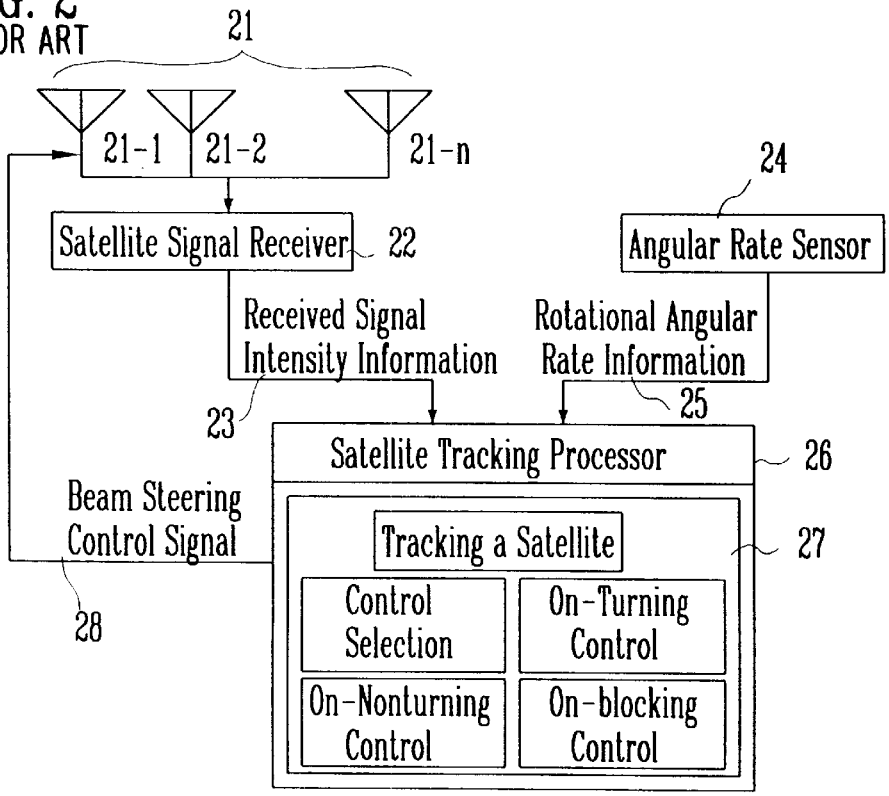
FIG. 2 PRIOR ART
FIGS. 2 shows a structure of a phased array antenna according to the prior art.
Figure 3:
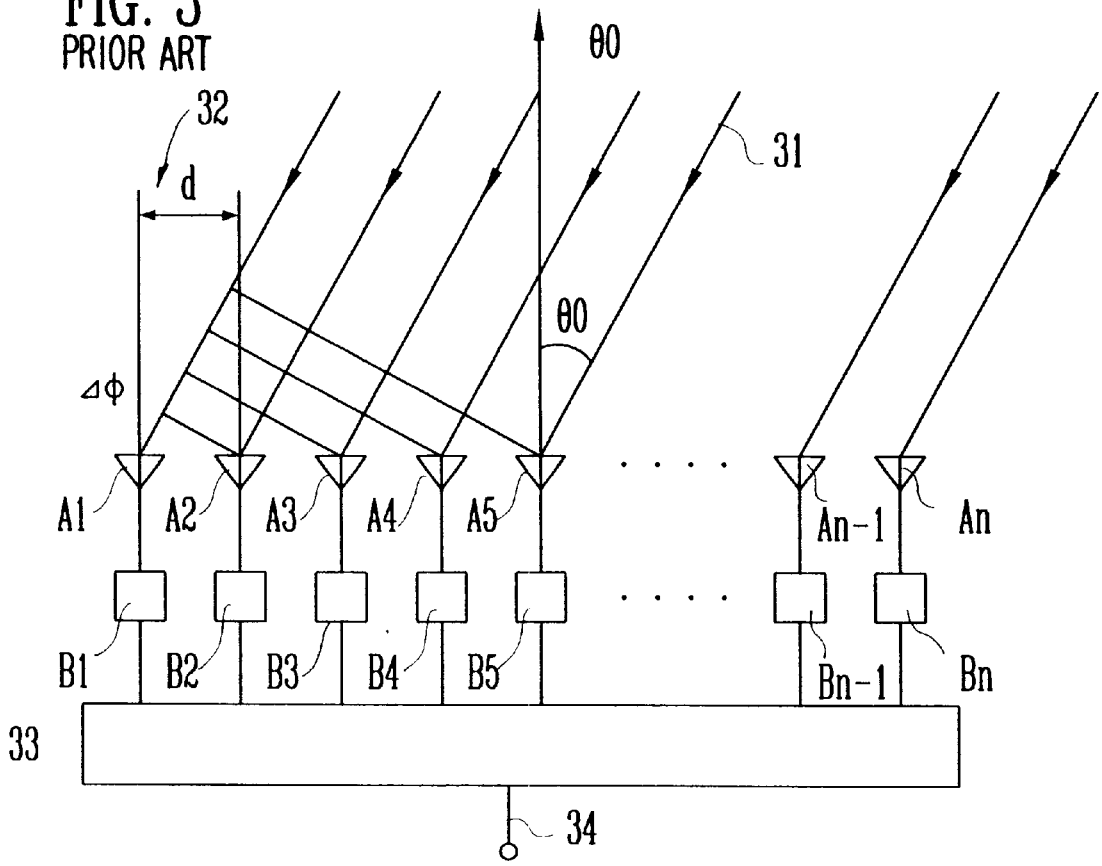
FIG. 3 PRIOR ART
FIG. 3 shows a functional view for illustrating a method for forming a sidle beam in a prior art phased array antenna.
Figure 4:
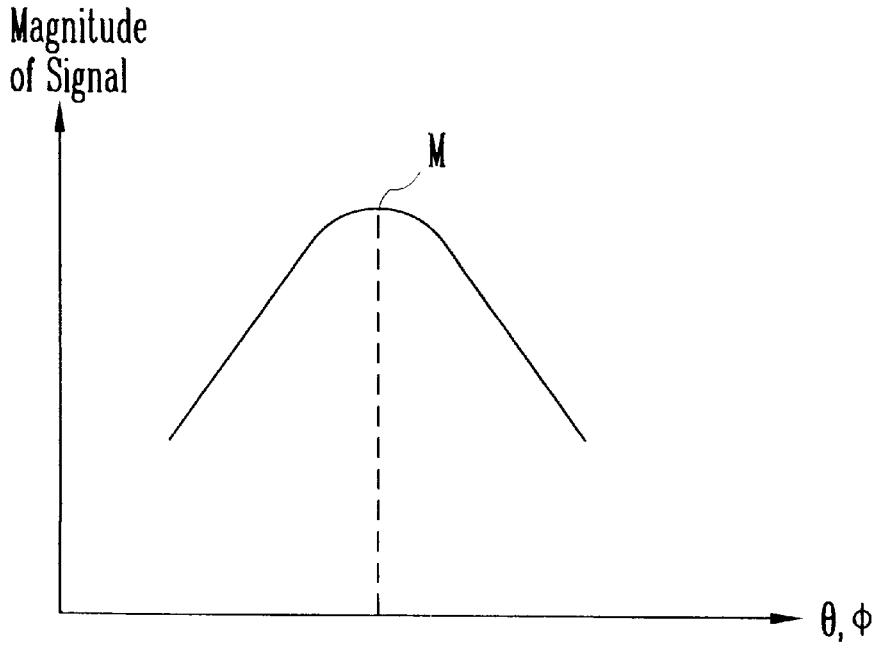
FIG. 4 PRIOR ART
FIG. 4 shows a graph for illustrating a satellite tracking method in the prior art phased array antenna.

FIG. 1 shows a functional view for illustrating a typical structure for mounting an antenna on a mobile vehicle, and particularly for illustrating a satellite broadcasting reception under the concept that a mobile vehicle 12 such as a moving vehicle receives signals for the satellite broadcasting or satellite communication.

An antenna radome 14 receives satellite radio waves 13 from a satellite 11. An active antenna signal processor 15 receives the satellite radio waves from the antenna radome 14 and performs a satellite tracking calculation. A satellite broadcasting receiver 16 processes the signals from the active antenna signal processor 15 and then transfers recovered information to users through TV monitor 17.

Figure 5:
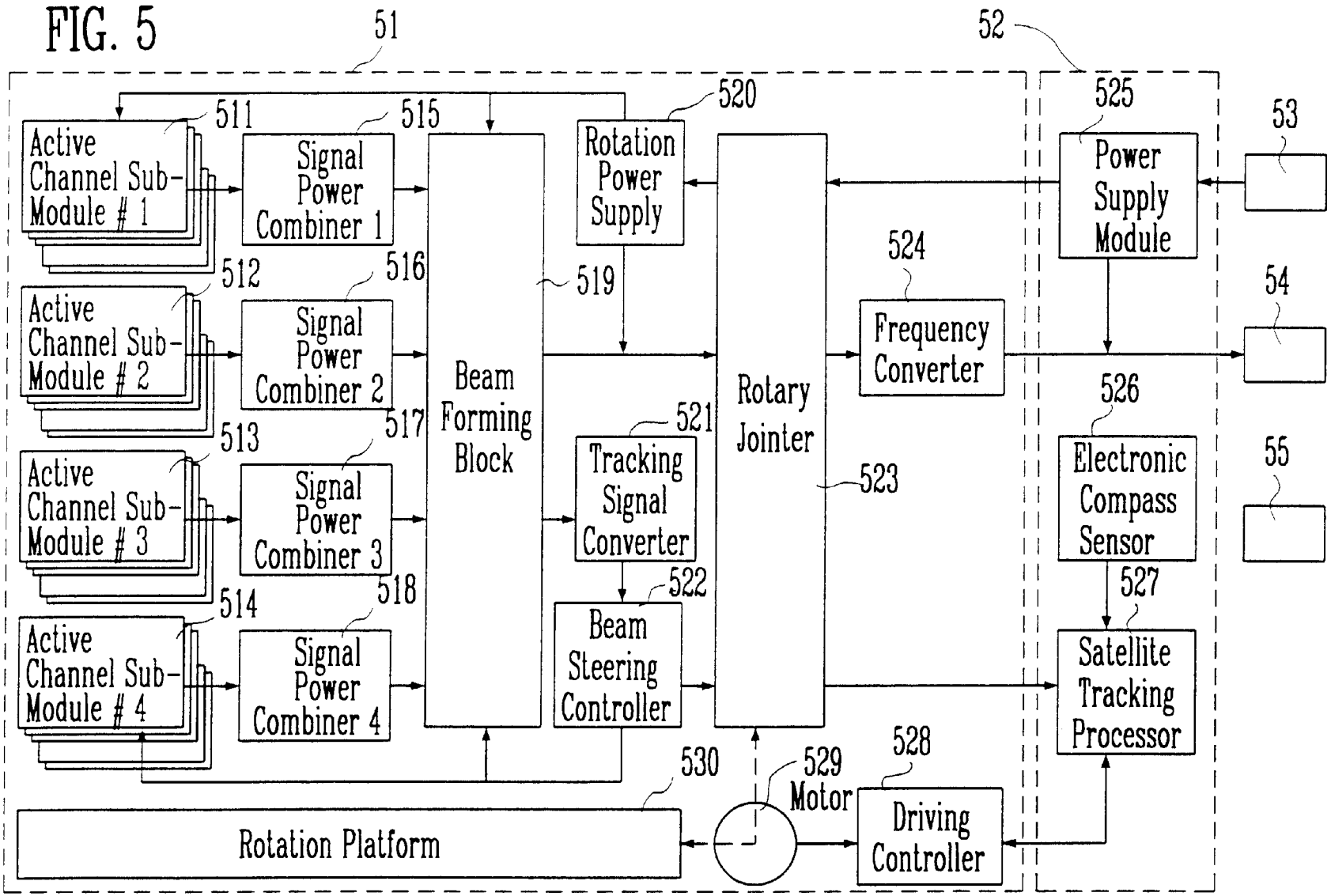
FIG. 5 shows a structure of an active channel antenna system of a mobile according to the present invention.

FIG. 5 shows a structure of an active channel antenna system of a mobile comprising an antenna radome 51 and an active antenna signal processor 52 according to the present invention.

The antenna radome 51 comprises m active channel sub-modules 511, 512, 513 and 514 divided into 4 groups, 4 signal power combiners 515, 516, 517 and 518, a beam forming block 519, a rotation power supply 520, a tracking signal converter 521, a beam steering control 522, a rotation platform 530, a rotary jointer 523, a frequency converter 524 and a driving control 528. The active antenna signal processor 52 comprises a satellite tracking processor 527, an electronic compass sensor 526 and a power supply module 525.

The antenna radome 51 receives signals from the satellite and then transmits them to the m active channel sub-modules divided into 4 groups. Primary beams of double beams are formed in active module channels through a reception signal low-noise amplifier, a phase delay control, a phased array and a power control. On one hand, each of the active channel sub-modules is divided into 4 groups 511, 512, 513 and 514 and each of the group is connected to the signal power combiners 515, 516, 517 and 518 respectively. The 4 signals from the signal power combiners are transmitted to the beam forming block 519. The 4 satellite signals transmitted to the beam forming block 519 are distributed into two parts. One part of the signals forms secondary beam of the double beam through the low noise amplifier, the phase delay control, the phased array, the power control and the signal power combiner, and then transmitted to the tracking signal converter 521. In addition, the other part of the signals is connected to the signal power combiner and then transmitted to a rotary jointer 523. The satellite information signals transmitted to the rotary jointer 523 are converted into intermediate frequencies in the frequency converter 524 and then provided to a satellite broadcasting receiver 54 through a band pass filter. The receiver recovers the information and then provides them to users through a TV monitor 55. The tracking signal converter 521 which receives the satellite signals transmitted together with the secondary beam detects magnitudes of the satellite tracking information signals and then transmits the information to the beam steering controller 522. The beam steering controller 522 transmits the information to the satellite tracking processor 527 of the active antenna signal processor 52 through the rotary jointer 523. A program in the satellite tracking processor 527 calculates the information together with information processing results of the movement of the mobile sensed through an electronic compass sensor 526 and then provides azimuth angle, elevation angle and tracking speed informations of the satellite positions. The azimuth angle and velocity information are provided to a driving controller 528. The driving control 528 controls and monitors the azimuth angle driving motor 529 to preform one-dimensional azimuth angle control proper to the related informations. The elevation angle information is provided to the beam steering controller 522. The beam steering controller 522 performs calculations for forming beams in order to control a desired one-dimensional elevation angle and then calculates phase delay value codes of the double beams assigned to the angular phase shifter. The assigned phase delay value codes are transmitted to the active channel sub-modules 511,512, 513 and 514 and beam forming block 519 for controlling the one-dimensional elevation angle, forming beams and adjusting beam steerings. Power from a vehicle power supply 53 is supplied to a power supply module 525 of the active antenna signal processor 52 and then supplied to each parts. For example, power is supplied to the rotation power supply 520 through the rotary jointer 523 and then supplied to each required parts on the rotation platform 530. The driving motor 529 operates the rotation platform 530, controlling the azimuth angle of the active antenna one-dimensionally. M active channel sub-modules 511, 512, 513 and 514 divided into 4 groups, 4 signal power combiners 515, 516, 517 and 518, the beam forming block 519, the tracking signal converter 521, the beam steering controller 522 and the rotation power supply 520 are mounted on the rotation platform 530. The rotary jointer 523 continuously transmits and supplies the satellite reception signals, the angular control signals and supply power without a stop in a relative rotation state of a fixed part of the antenna radome 51 and a rotating part on the rotation platform 530. The electronic compass sensor 526 provides three axis posture informations of an absolute steering and a forward declination of the mobile at the moment that the measurement is demanded, and a side declination.

Figure 6:
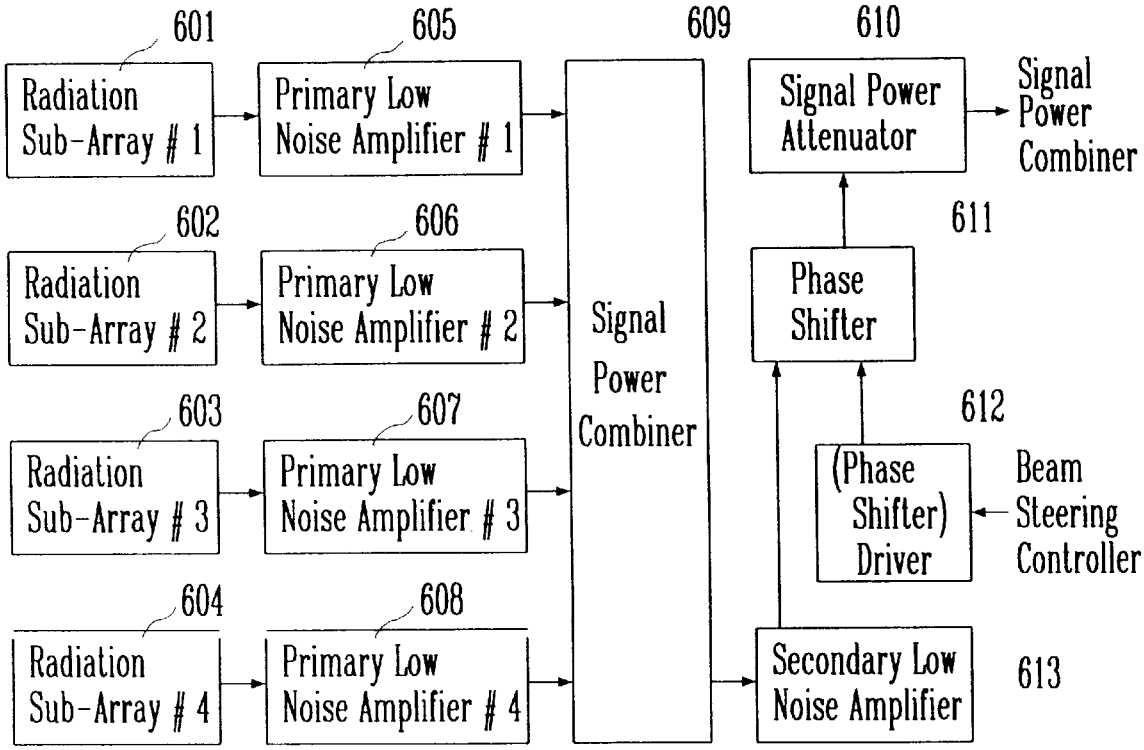
FIG. 6 shows a structure of an active channel sub-module of the active channel antenna system of the mobile.

FIG. 6 shows an active channel sub-module of a mobile active channel antenna system according to the present invention.

The active channel sub-module comprises n-i radiation sub-arrays 606, 602, 603 and 604, n-i primary low noise amplifiers 605, 606, 607 and 608, a signal power combiner 609, a secondary low noise amplifier 613, a phase shifter 611, a (phase shifter) driver 612 and a signal power attenuator 610, where i is 0 or a integer number smaller than n−1 for example, n-i is 4.

The signals transferred to the antenna radome 51 of FIG. 1 are transmitted to the radiation sub-arrays 601, 602, 603 and 604 of the active channel sub-module. The radiation sub-arrays 601, 602, 603 and 604 are fixed phased array antenna consisted of a coupling of p unit antenna elements which are in-phase delayed. The satellite signals added gains in the radiation sub-arrays 601, 602, 603 and 604 are amplified to low noise in primary low noise amplifiers 605, 606, 607 and 608 and ensure performance of antenna gains to noise constants. The amplified signals are connected to the signal power combiner 609, losses of the signal gains are recovered in the secondary low noise amplifier 613 and then the signals are delayed in the phase shifter 611 to have required phases. The signal power attenuator 610 compensates the delayed signals for their gain differences among m active channel sub-modules. An output from the signal power attenuator 610 is provided to the signal power combiner (515 to 518 of FIG. 5). The (phase shifter) driver 612 receives phase delay codes from the beam steering control (522 of FIG. 5) and controls the phase of the phase shifter 611 to a specific value.

Figure 7:
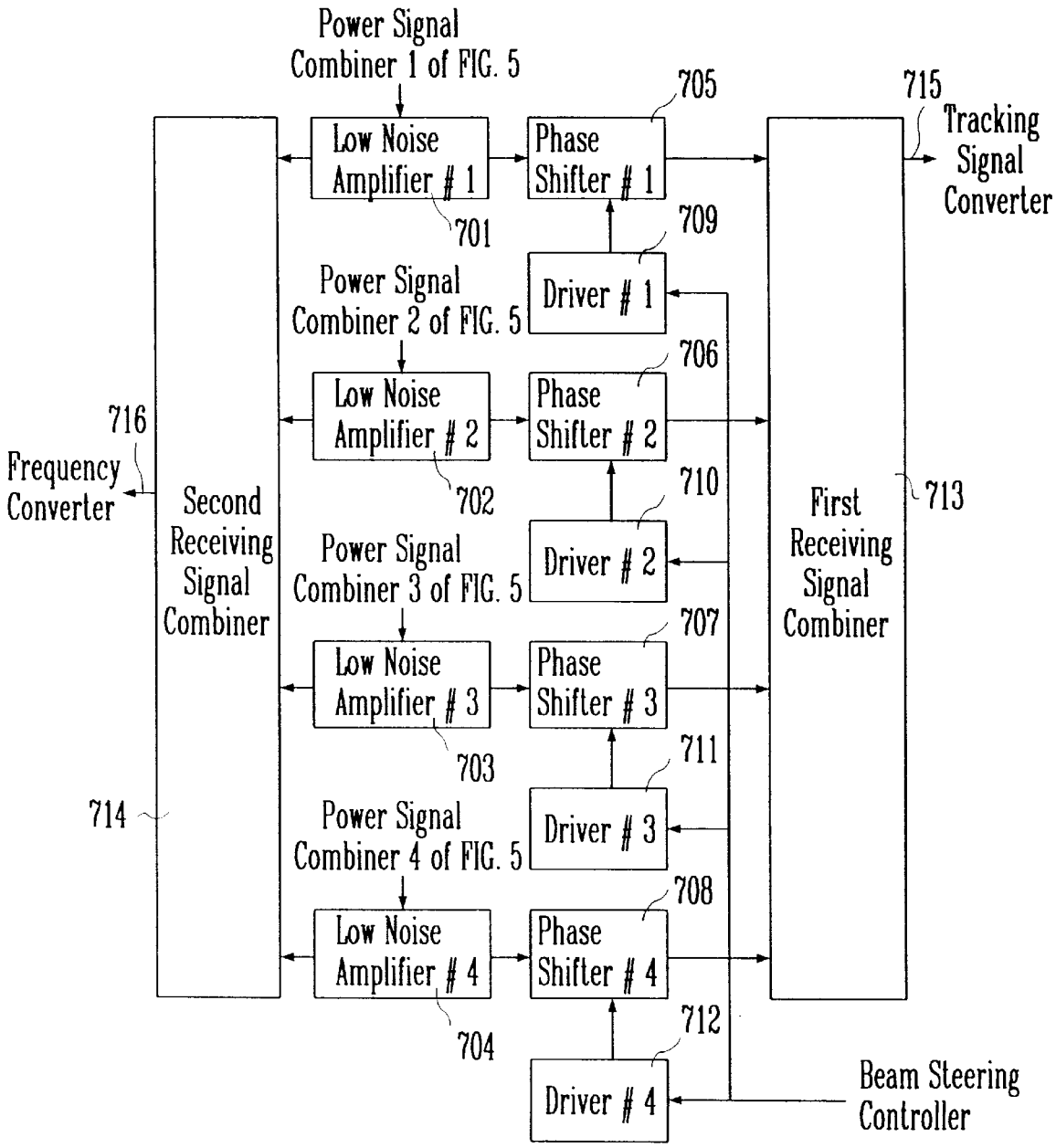
FIG. 7 shows a structure of a beam forming block of the active channel antenna system of the vehicle.

FIG. 7 shows a structure of a beam forming block of an active channel antenna system according to the present invention.

The beam forming blocking comprises 4 low noise amplifiers 701, 702, 703 and 704, 4 phase shifters 705, 706, 707 and 708, 4 (phase shifter) drivers 709, 710, 711 and 712, and 2 signal power combiners 713 and 714.

When signals from the satellite arrive at the antenna radome (51 of FIG. 5), the active channel sub-modules 511, 512, 513 and 514 control phase delays of the signals in order to form a primary beam of the double beams. The signals are divided into 4 groups and then transmitted to the beam forming blocks. The signals from the signal power combiners 515, 516, 517 and 518 are compensated for their gain losses and distributed to low noise amplifiers 701 to 704. First, one of the signals is phase-shifted to form a secondary beam of the double beam through the phase shifter 705, coupled with three phase delayed satellite signals of the secondary beam from other groups through the first signal power combiner 713 and then provided as secondary beam signals 119. On the other hand, the other distributed signals are coupled with three satellite signals from other groups through the second signal power combiner 714 and then provided as satellite broadcasting signals 716 received in the antennas.

Figure 8:
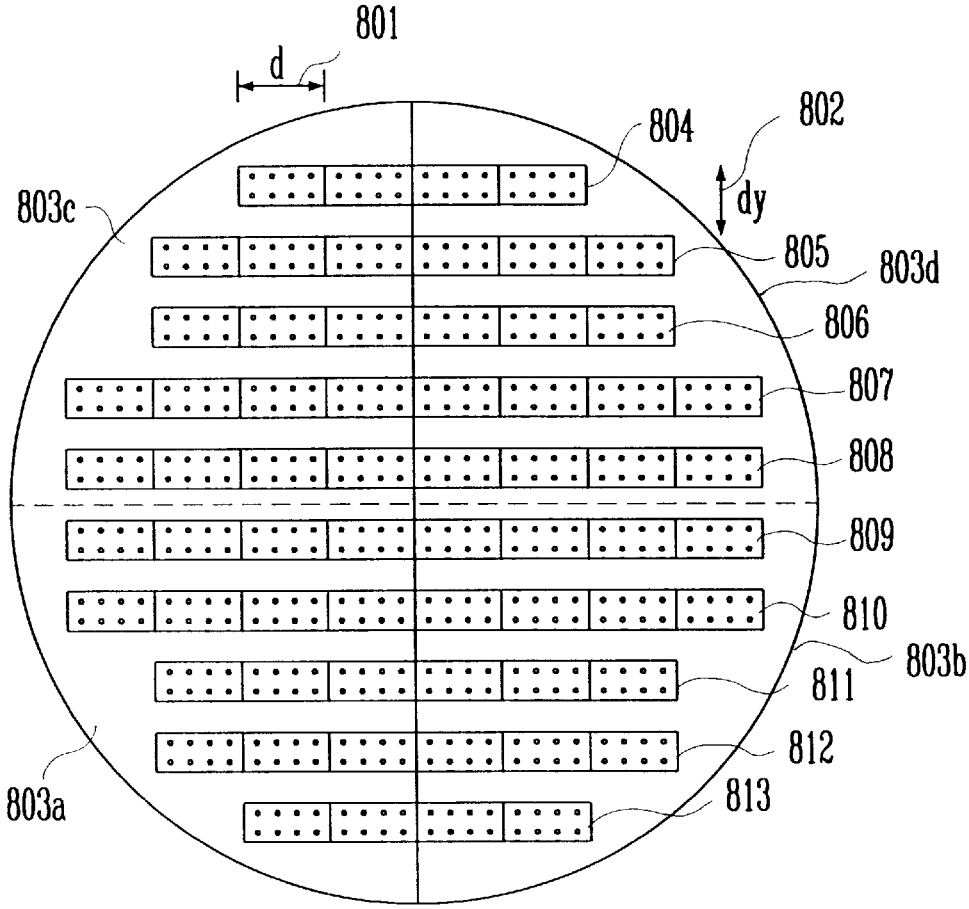
FIG. 8 shows a functional view for illustrating a structure of a phased array according to the present invention.

FIG. 8 shows a functional view for illustrating a structure of a phased array according to the present invention.

First, the satellite signals are excited to a radiation sub-array of the phased array structure. The radiation sub-arrays are arranged on a plane orienting to the satellite. An arrayed structure of the radiation sub-arrays are determined by the following rules on the basis of the magnitude of the antenna to be manufactured. That is, the antenna is constructed to a circle and the magnitude of the circle is determined by the gain. N radiation sub-arrays are arranged sequentially and regularly in an inside of the circle. Each of the radiation sub-arrays are arrayed in a certain length 801 dx and a width 802 dy. The radiation sub-arrays of the antenna have g columns and h rows. The radiation sub-arrays are divided into 4 groups of the phased array unit areas of double beams

803*a,* 803*b,* 803*c* and 803*d,* and each groups has equal radiation sub-arrays for satisfying the rules and being included in an inside of the circle. Each rows of the groups constitutes the m active channel sub-modules (see FIG. 6). The number of the radiation sub-arrays in each columns 804, 805, 806, 807 and 808 of the groups satisfies n-i rule. N is equal to the number of the radiation sub-arrays of the longest column in the groups and i is an arbitrary number which makes the number n-i of the radiation sub-arrays in each column to be a maximum.

Figure 9:
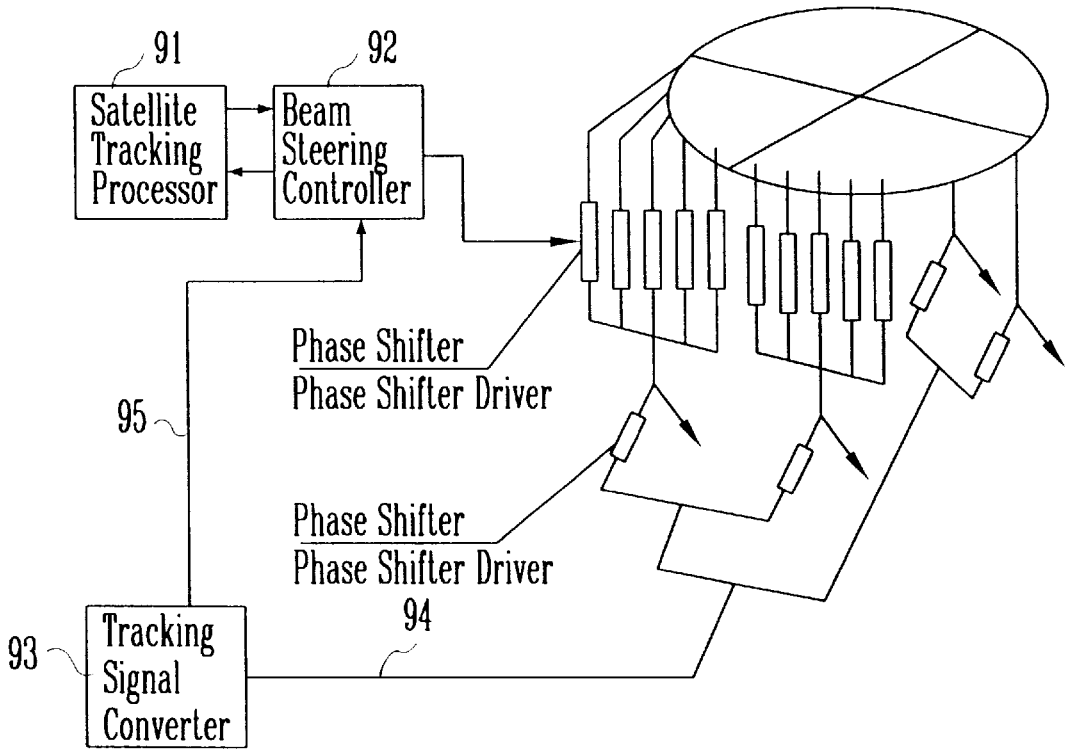
FIG. 9 shows a functional view for illustrating a method for forming a double beam according to the present invention.

FIG. 9 shows a functional view for illustrating a method for forming a double beam according to the present invention.

A primary beam of the double beam is a satellite forward steering beam and a secondary beam is a tracking beam. If satellite steering informations from a satellite tracking processor 91 are provided to a beam steering control 92, the beam steering control 92 provides codes to the (phase shifter) driver of each active channel sub-modules and the signals through the phase shifter are delayed by a certain phase, forming the primary beam. If the reception magnitude of the secondary beam signal 94 is detected in a tracking signal converter 93 and satellite tracking error signals 95 are provided to the satellite tracking processor 91 through the beam steering control 92, a program calculates them and then provides codes to the beam steering control 92, reforming the secondary beam. The codes are transmitted to the (phase shifter) driver of the beam forming block and the phase of the primary beam signal transmitted through the phase shifter therefrom is additionally delayed, forming the secondary beam.

Figure 10:
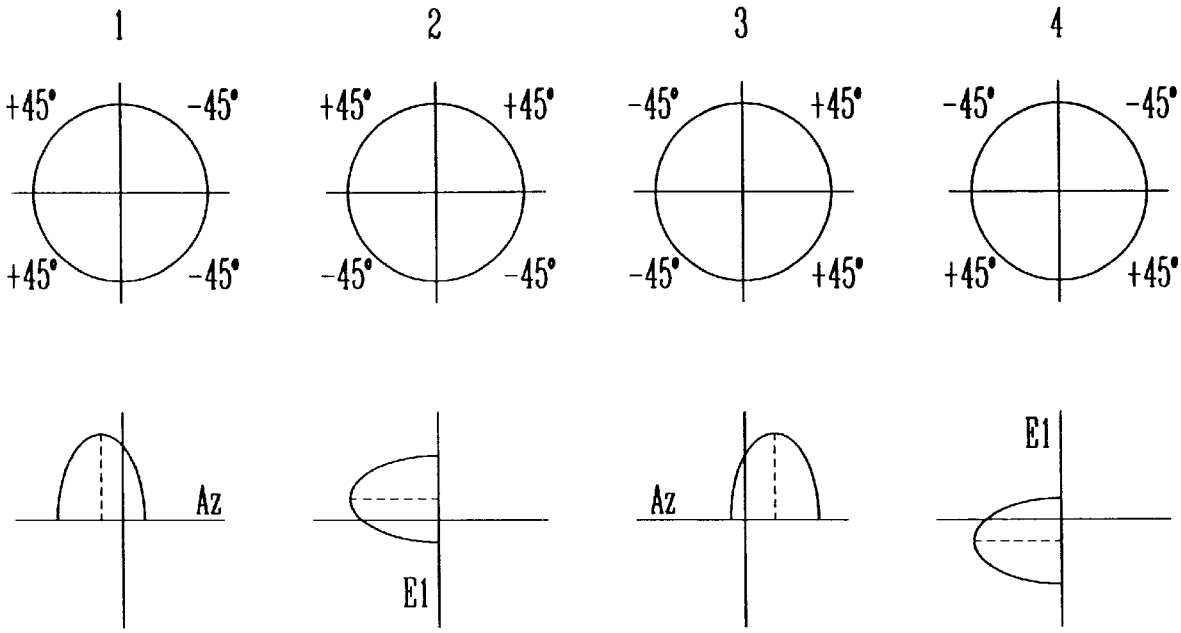
FIG. 10 shows a functional view for illustrating a secondary beam steering in the active antenna system of the vehicle according to the present invention.

FIG. 10 shows a functional view for illustrating a secondary beam steering of an active antenna system of a mobile according to the present invention. As shown in the drawing, the secondary beam sequentially produces secondary beam steering patterns each having different steerings by assigning delay phases +45, +45, −45 and −45 degrees to 4 unit area of the phased array of the secondary beam and then sequentially altering them to a time interval t according to the tracking sequence.

Figure 11:
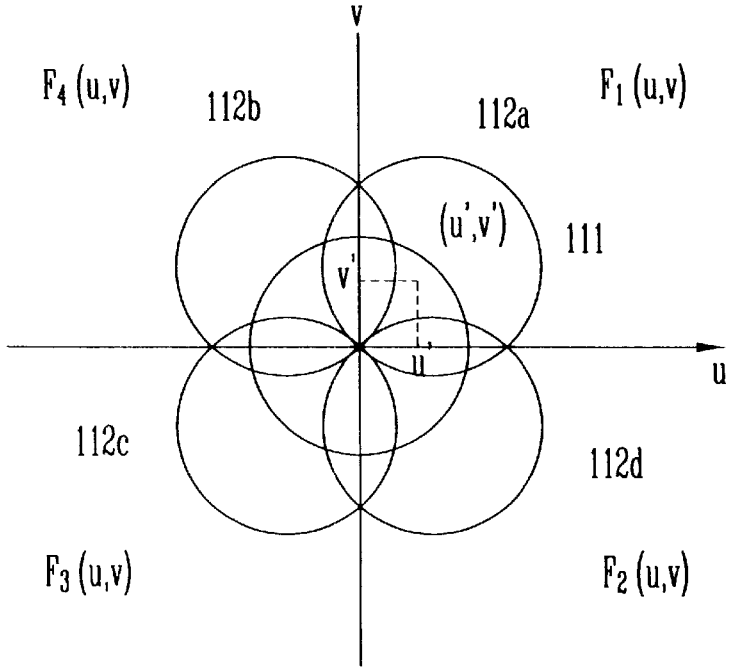
FIG. 11 shows a functional view for illustrating a double beam pattern in the active antenna system of the vehicle according to the present invention.

FIG. 11 shows a functional view for illustrating a double beam pattern of an active antenna system of a mobile vehicle according to the present invention.

An initial actual satellite steering is in coordinates (uo, vo)=(O,O) and if the primary beam has a steering effective area (111) of a dB, the secondary beam having a tracking effective area of b dB shifts steering center coordinates (u,v) of the secondary beam steering patterns 112*a,* 112*b,* 112*c* and 112*d* in a sequence illustrated in FIG. 10 based on an a dB steering effective area track of the primary beam. If the coordinates of the actual satellite are shifted to (u',v'), the magnitudes of the satellite signals received in the secondary beam steering patterns 112*a,* 112*b,* 112*c* and 112*d* are different. The shifted values (u',v') of the satellite are calculated from the differences and the center coordinates of the primary beam are shifted from (O,O) to (u',v'). Such a procedure is repeated several times for continuous satellite tracking.

Figure 12:
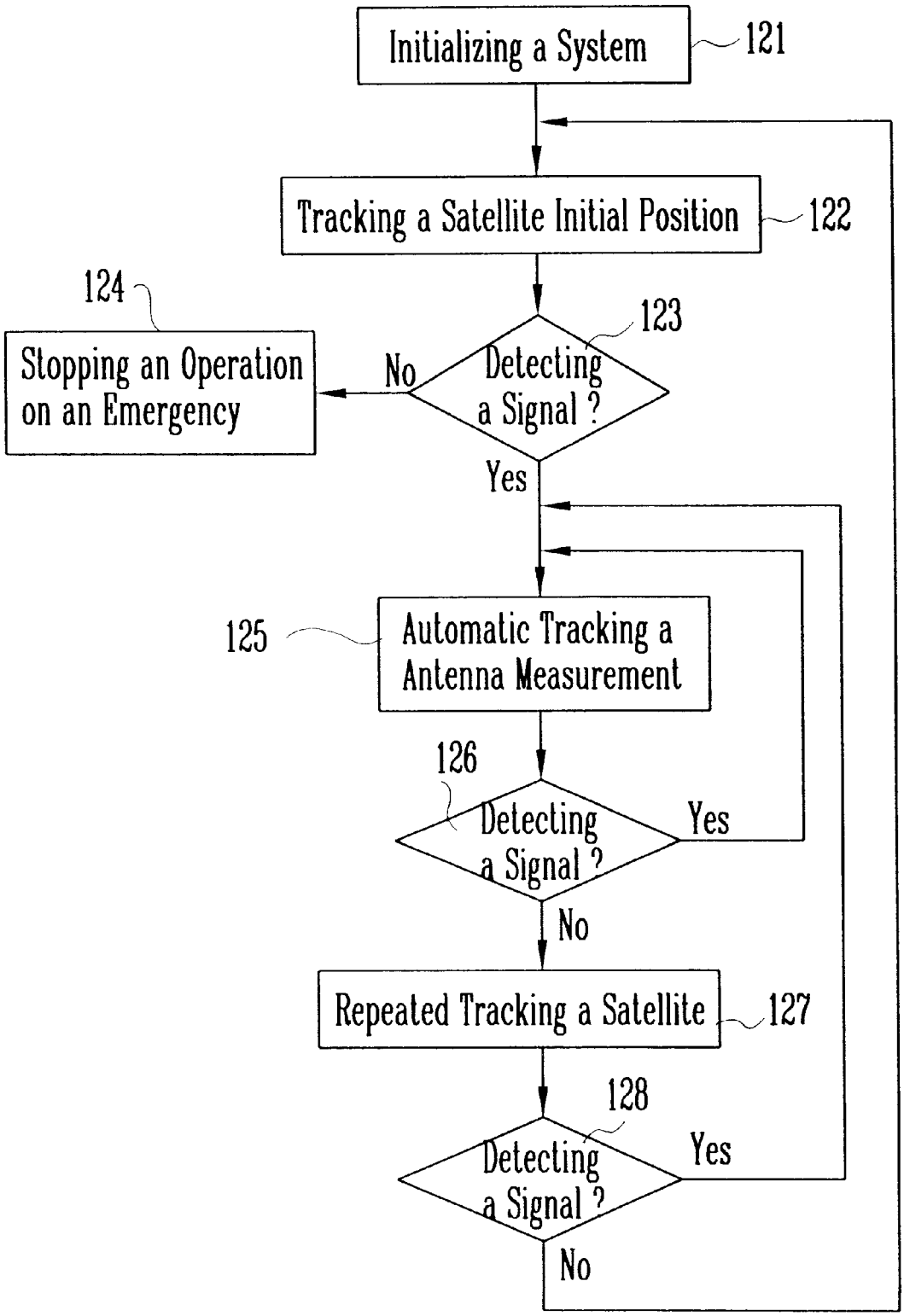
FIG. 12 shows a flow for illustrating a satellite tracking method according to the present invention.

FIG. 12 shows a flow chart for illustrating a satellite tracking method according to the present invention. The satellite tracking is performed by applying an electronic compass sensor using the double beam satellite tracking and absolute steering sensing, and also using a satellite initialization program, a satellite initial tracking program, an antenna measurement automatic tracking program and a satellite repeated tracking program.

First, the system is initialized at a step 121. The initialized system performs open loop tracking which applies the electronic compass sensor in an initial tracking of the satellite, and thus tracks the satellite initial position at a step 122. It is first confirmed whether signals are detected at a step 123. If the signals are detected and a position of the satellite is captured, the antenna measurement automatic tracking which applies the double beam satellite tracking as a closed loop tracking is repeatedly performed at a step 125. If the signals are not detected, i. e., if the satellite initial tracking fails for a certain time, the operation is stopped on an emergency according to the determination of the user at a step 124. Then it is secondarily confirmed whether the signals are sensed at a step 126. If the signals are not sensed and thus the satellite tracking is failed, the satellite repeated tracking is performed as an open loop tracking which applies an electronic compass sensor at a step 127. If the signals are detected as a result of the confirmation and thus the satellite tracking succeeds, the process proceeds to an antenna measurement automatic tracking step 125.

It is confirmed in the third time whether the signals are detected at a step 128. If the signals are detected and thus the satellite tracking is succeeded, the step proceeds to the antenna automatic tracking step 125. If the signals are not detected and thus the satellite tracking has failed, the process proceeds to the satellite initial tracking step 122.

As described above, there are effects according to the present invention as follows. First, both of the one-dimensional array control of an elevation angle and one-dimensional mechanical control of an azimuth angle are used, providing an economical and effective system to a two-dimensional satellite array antenna, and an improved performance of a satellite tracking velocity to a two-dimensional mechanical control antenna. Second, compared with the conventional mono pulse tracking method which divides gain with a single beam pattern and then performs satellite tracking, the present invention improves tracking gain loss by using a secondary beam and thus providing a variable active high speed satellite tracking function and a secondary beam gain corresponding to a primary beam gain. Third, the present invention improves inaccuracy of tracking position determination which can be occurred in an one-dimensional step tracking mode by using two-dimensional tracking with a double beam. Fourth, the present invention improves the system such that it becomes an economical and effective system having the same performance by reducing the number of control elements compared with the system which controls the phase of the unit antenna elements by controlling the phase using radiation sub-array for phased array control. Fifth, the present invention improves fixation of a structure of a conventional system array by applying freely the gain and magnitude of the desired antenna using a variable phased array of the radiation sub-array. Sixth, the present invention prevents that the satellite tracking effects actual satellite information reception as a conventional actual satellite information reception uses the same beam in satellite tracking since the primary beam of the double beam tracks only the actual satellite information reception and the secondary beam tracks only the satellite. Seventh, the present invention reduces a necessary recovering time after the failure of the initial satellite tracking and steering control which measures the relative steering from angular rate using the conventional angular rate sensor by using the electronic compass sensor which senses an absolute steering and 3 axis angle variation for satellite tracking. It will be apparent to those skilled in the art that various modification and variations can be made in a structure of an active antenna system of a mobile and a satellite tracking method with the system of the present invention without departing from the spirit or scope of the inventions. Thus, it is intended that the present invention cover the modifications and variations of this invention provided they come within the scope of the appended claims and their equivalents.

The foregoing description, although described in its preferred embodiment with a certain degree of particularity, is only illustrative of the principles of the present invention. It is to be understood that the present invention is not to be limited to the preferred embodiments disclosed and illustrated herein. Accordingly, all expedient variations that may be made within the scope and the spirit of the present invention are to be encompassed as further embodiments of the present invention.

What is claimed is:

1. A vehicle active antenna system, comprising:

multiple groups of plural active channel sub-modules which receive satellite signals transferred to an antenna radome;

a plurality of signal power combiners which receive the satellite signals from the active channel sub-modules;

a beam forming block which distributes the satellite signals from the signal power combiners form a secondary beam, couples the signal power, and transmits satellite reception signals, angle control signals and a supply power in a relative rotation state of a fixed part and a rotating part to a rotary jointer which is not opened and continuously transmits and supplies them;

a frequency converter which converts satellite information signals from the rotary jointer into intermediate frequencies;

a satellite broadcasting receiver which provides signals which are frequency converted satellite information signals filtered by a bandpass filter;

a tracking signal converter which receives the satellite signals transmitted through the secondary beam formed in the beam forming block and detects the magnitude of the satellite tracking information signals;

a beam steering controller which transmits the satellite tracking information signals transferred from the satellite signal converter through the rotary jointer, performs calculations for forming beams for one-dimensional elevation angle control, and then calculates phase delay value codes of desired double beams assigned to a phase shifter;

an electronic compass sensor which calculates satellite tracking information signals transmitted through the rotary jointer from the beam steering control together with the information processing results of the sensed movement of the mobile, creates azimuth angles, elevation angle information and tracking speed informations, and provides three-axis posture information regarding absolute steering, a forward declination and a side declination;

a driving controller which provides the azimuth angles and speed information created in the electronic compass sensor and controls and monitors a driving motor so as to control one-dimensional azimuth angle;

a power supply module which supplies power from the vehicle power supply to each part of the system; and a rotation platform which receives the power from the power supply module through the rotary jointer and controls one-dimensionally the azimuth angle of the active antenna by the driving motor.

2. The active antenna system of claim 1, wherein the active channel sub-module comprises:

a plurality of radiation sub-arrays which receives satellite signals from the antenna radome;

a plurality of primary low noise amplifies which amplify in low noise the satellite signals obtained reception gains in the plurality of radiation sub-arrays and ensure performance of a gain to noise constant;

a signal power combiner which couples the amplified signals in the plurality of primary low noise amplifiers;

a secondary low noise amplifier which recovers gain loss relative to an output of the signal power combiner;

a phase shifter which delays the phase of the output signals of the secondary low noise amplifier by a desired phase;

a signal power attenuator which compensates for the gain difference of the signals delayed by the phase shifter between the active channel sub-modules; and a driver which receives phase delayed codes in a beam steering control and then controls the phase of the phase shifter into a certain value.

3. The active antenna system of the mobile of claim 1, wherein the radiation sub-arrays are arranged in a plane oriented to the satellite, the radiation sub-arrays have a certain horizontal spacing and a certain perpendicular spacing, phased array unit areas of the double beam are divided into 4 groups, each group having equal numbers of radiation sub-arrays which satisfy array rules and are included in a circle, each row of the group constitutes active channel sub-modules, and the number of the active channel-module is such that n-i rules are satisfied where n is an arbitrary number in order that the number i of the radiation sub-arrays of the longest column in each groups becomes a maximum.

4. The active antenna system of claim 1, wherein the beam forming block comprises:

a plurality of low noise amplifiers which compensate for and distribute the gain loss of the signal from the reception signal combiner of the antenna system;

a plurality of phase shifters which receive one of the signals distributed from the plurality of the low noise amplifiers and delay the phase for forming a secondary beam of the double beam;

a first reception signal combiner which couples the delayed signals from the plurality of phase shifters; and a second signal power combiner which couples the distributed opposite side signals from the plurality of the low noise amplifiers and then provides antenna reception satellite broadcasting signals.

5. A satellite tracking method using an active antenna system of a mobile, said method comprising the steps of:

performing open loop tracking using an electronic compass sensor in an initial satellite tracking after initialization of the system and then tracking an initial position of the satellite;

confirming first whether signals are detected as a result of the initial satellite position tracking;

performing repeatedly an automatic antenna measurement tracking which applies a double beam satellite tracking as a closed loop tracking if any signal is not detected after confirming detection of a primary signal and the position of the satellite is captured;

stopping an operation in an emergency based on a determination of a user if any signal is not detected after confirming detection of the primary signal;

confirming secondly whether the signals are detected;

performing repeatedly a satellite tracking as an open loop tracking which applies an electronic compass sensor if any signal is not detected after confirming secondly the signal detection and thus the satellite tracking has failed;

proceeding to the automatic antenna measurement tracking step if the signals are detected after confirming secondly the signal detection and thus the satellite tracking is succeeded;

confirming thirdly whether the signals are detected, proceeding to an automatic antenna measurement tracking step if any signals is not detected after confirming thirdly the signal detection; and proceeding to the initial satellite tracking step if any signals is not detected after confirming thirdly the signal detection and thus the satellite tracking is failed.

6. The satellite tracking method of claim 5, wherein the primary beam of the double beam is formed by the steps of:

transferring codes to the phase shifter driver of the active channel sub-module when phase steering information are provided from a satellite tracking processor to a beam steering control; and delaying the phase of the signals via the phase shifter after transferring the codes to the phase shift driver.

7. The satellite tracking method of claim 5, wherein the secondary beam of the double beam is formed by the steps of:

detecting a reception magnitude of the arbitrary secondary beam in a tracking signal converter and then transferring a satellite tracking error signal to the satellite tracking processor via the beam steering controller;

calculating and determining a reception magnitude of the arbitrary secondary beam transferred to the satellite tracking processor and then providing codes to the beam steering controller; and transferring the codes provided to the beam steering controller to the phase shift driver of the beam forming block and then delaying additionally the phase of the primary beam signals via the phase shifter driver.

8. The satellite tracking method of claim 5, wherein the secondary beam of the double beam, +45, +45, −45 and −45 degrees of delay phase are assigned to 4 unit areas of the phased array, are altered sequentially and assigned to arbitrary time intervals depending on a tracking sequence, and then the secondary beam steering patterns each having different steering are arranged sequentially.

9. The satellite tracking method of claim 5, wherein steering patterns of the double beam are positioned in the origin, if the patterns have arbitrary steering effective areas, the secondary beam having arbitrary tracking effective areas shifts the steering center of the secondary beam steering pattern to the sequence of +45, +45, −45 and −45 along the steering effective area track of the secondary beam, if the actual satellite coordinates are shifted to arbitrary coordinates, shifted coordinates values are calculated based on the difference of the satellite signals received in the secondary beam steering pattern, and then the center coordinates of the primary beam are shifted from the origin to the arbitrary coordinates to which the actual coordinates are shifted.

* * * * *